United States Patent [19]

Miller

[11] Patent Number: 5,010,604

[45] Date of Patent: Apr. 30, 1991

[54] AUTOMATIC HAIR AND SCALP TREATMENT APPARATUS FOR CONTACTING THE SCALP BEHIND THE EARS

[75] Inventor: Archie M. Miller, Brentwood, Tenn.

[73] Assignee: IHT, Inc., North Nashville, Tenn.

[21] Appl. No.: 504,846

[22] Filed: Apr. 5, 1990

[51] Int. Cl.[5] ..... A45D 19/10

[52] U.S. Cl. ..... 4/519; 4/520; 132/212

[58] Field of Search ..... 4/515–523; 132/212, 272

[56] References Cited

U.S. PATENT DOCUMENTS

| | | | |
|---|---|---|---|
| 2,854,969 | 10/1958 | Nolan | 4/518 X |
| 3,521,647 | 1/1970 | Mercer | 4/518 X |
| 3,636,961 | 1/1972 | John et al. | 132/212 |
| 3,894,546 | 7/1975 | Nolan | 4/518 X |
| 4,771,487 | 9/1988 | Little | 4/519 |
| 4,834,121 | 5/1989 | Bell | 4/516 X |

*Primary Examiner*—Charles E. Phillips

*Attorney, Agent, or Firm*—Norman L. Wilson, Jr.

[57] ABSTRACT

An automatic hair and scalp treatment machine which includes a bowl, and a closure therefor, adapted to enclose the head with the face outside the closure. Also included are spray manifolds on an oscillating arcuate header, and driving device imparting partial rotation to the arcuate header. Each spray manifold having a spray head oriented to direct spray around the ear.

3 Claims, 2 Drawing Sheets

AUTOMATIC HAIR AND SCALP TREATMENT APPARATUS FOR CONTACTING THE SCALP BEHIND THE EARS

BACKGROUND OF THE INVENTION

The invention, in one of its aspects, pertains to automatic hair and scalp treatment machines. In another of its aspects the invention pertains to improvements in the apparatus characterized in earlier U.S. Pat. No. 4,834,121.

The invention which was the basis of U.S. Pat. No. 4,834,121 overcame the problems associated with U.S. Pat. No. 3,521,647, and particulary the disadvantages of scalp massaging devices, such as those described in U.S. Pat. Nos. 2,566,600, 2,854,970 and 3,177,868. The invention in 3,521,647 did have some drawbacks. It was not until after a large number of hair treatments that it was found that in the earlier machine the contacting action was not quite that desired. Accordingly it was then improved by the invention in U.S. Pat. No. 4,834,121. That apparatus included a bowl, and a closure therefor, adapted to enclose the head with the face outside the closure. Also included were spray manifolds on an oscillating arcuate header, and driving means imparting partial rotation to the arcuate header. It was found that there were gaps or skips in spray in prior art devices. It was this imperfect action which was improved by the invention in U.S. Pat. No. 4,834,121. In U.S. Pat. No. 4,834,121, means were provided of dispensing treating solutions in the form of sprays so oriented that they coacted with each other as they sprayed the head from front to back.

The apparatus of U.S. Pat. No. 4,834,121 solved most of the problems which previously surfaced. But one unsolved problem was that of contacting the area of the head behind the ears. If hair is being shampooed, this area is relatively unimportant. Hence attention has not been accorded that aspect of the treating apparatus. Rather, to avoid getting solutions in the ears, no attempt has been made to direct sprays close to them. The spreding of the sprays has been relied upon to treat the space around the ears. However, with the discovery that sprays can be used in the treatment of dermatoses such as psoriasis, it has become much more important to contact the head behind the ears. To do so was not without its problems, primarily because the curve or path which the spray must travel about the ears is a cardioid. It has now been found that under certain conditions spray from nozzles on an oscillating manifold can be made to trace such a curve around the ears.

SUMMARY OF THE INVENTION

As noted, this invention is concerned with the type of apparatus for use in applying hair and scalp treating solutions to the human head, which includes a bowl, a closure therefor adapted to enclose the head with the face outside the closure and the back of the neck on the bowl front. An arcuate header, in the form of upper and lower spray manifolds, is adapted to oscillate in an arc from a point opposite the forehead to a point opposite the neck. Means are provided for imparting partial rotation to the arcuate header to effect this oscillatory movement, and to dispense adjacent pressurized sprays of treating solutions. Herein it has been found that sprays can be directed behind the ears if the oscillatory axis is offset from the ears, and if the nozzles on each manifold near the ears are inclined outwardly away from the other manifold. In addition the inclined nozzles on the lower manifold must be closer to the manifold oscillation axis than the inclined nozzles on the upper manifold. Adopting these desiderata, spray from the nozzles inscribes a curve by manifold oscillation which is the involute of a circle encircling the ears. This spray pattern enables spray from the nozzles to contact the scalp behind the ears without running into them.

BRIEF DESCRIPTION OF THE DRAWINGS

For a complete understanding of the invention reference is made to the accompanying drawings.

DETAILED DESCRIPTION OF THE INVENTION

Figure 1:
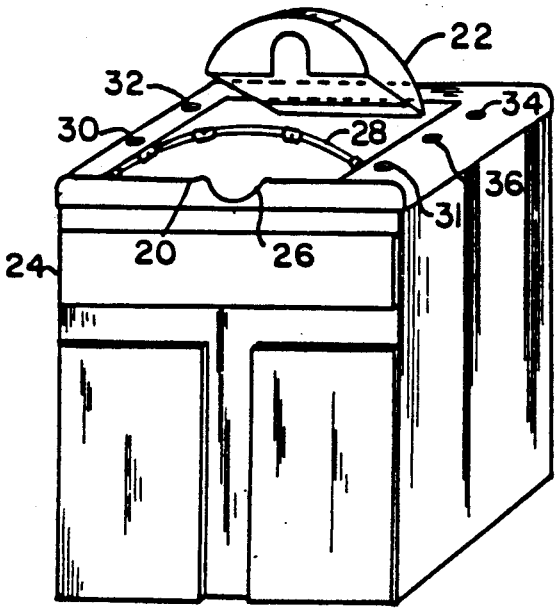
FIG. 1 is a perspective view of the apparatus which is improved by this invention.
Figure 2:
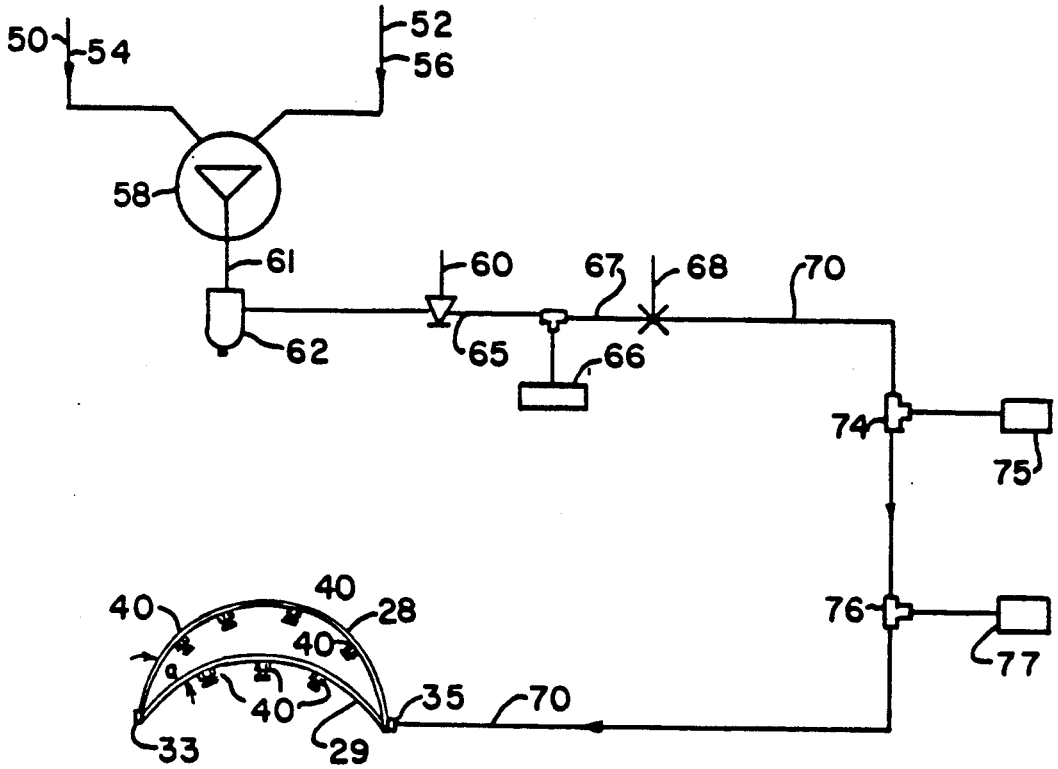
FIG. 2 is a diagrammatic representation of the spray system incorporated in the apparatus.

Preliminarily, considering the general features of the invention, as shown in FIG. 1, the automatic hair treating apparatus includes a bowl 20 mounted in a cabinet 24, and provided with a lid or cover 22. The neck rest is shown at 26. One of the two washing elements, upper manifold 28 is visible. The other manifold 29 is disposed at an angle thereto as shown in FIG. 2. Spray nozzles are mounted on the manifolds to dispense either fan shaped or cone shaped sprays. Control knobs 30, 31, 32, 34 and 36 are also visible in FIG. 1.

Prior to discussing the invention herein, the operation of the apparatus should be described, Referring to FIG. 2, the header includes two or more manifolds joined on a common axis 33 and 35. Partial rotation or oscillation of this header unit is accomplished by reduction gears, bell crank arms, and other well known means for achieving oscillation. Referring to FIG. 2, hot water 50 and cold water 52 enter the shampoo machine through lines 54 and 56 respectively. These flow into a temperature control valve 58. Flow into temperature control valve 58, and hence throughout the system, is controlled by a solenoid valve 60. Before passing through solenoid valve 60, the incoming water in hydraulic line 61 passes through a water filter 62. To increase the pressure of the incoming water to a pressure within a range better suited to the action of spraying manifolds 28 and 29 water line 65 conducts the solutions to pump 66. The output from this pressure pump flows through line 67 to pressure regulator 68. From the pressure regulator, the solutions, now at the desired temperature and pressure, flows through line 70 to manifolds 28 and 29. These manifolds oscillate about an axis or pivot points 33 and 35 so that they progress back and forth opposite the head. A problem which, until the machine began being used for treating dermatoses, has gone unnoticed, has been that of contacting the area behind the ears.

It has now been found that if several parameters are observed, the curve which spray inscribes around the ears by manifold oscillation is the involute of a circle. Thus, the axis of the circle which forms the oscillatory arc in which the manifolds move should be offset from the ears. The nozzles on each manifold near the ears should be inclined outwardly relative to the plane of the manifold, that is away from the other manifold, relative to the plane in which the manifold lies. And the inclined nozzles should be disposed on the manifolds near the ears with nozzles on the lower manifold closer to the oscillation axis than the inclined nozzles on the upper manifold. The resulting spray pattern will then be such that the sprays from the upper and lower inclined nozzles coact to inscribe curves around the ears which are the involutes of circles, so that the spray from the inclined nozzles contacts the scalp behind the ears.

Figure 3:
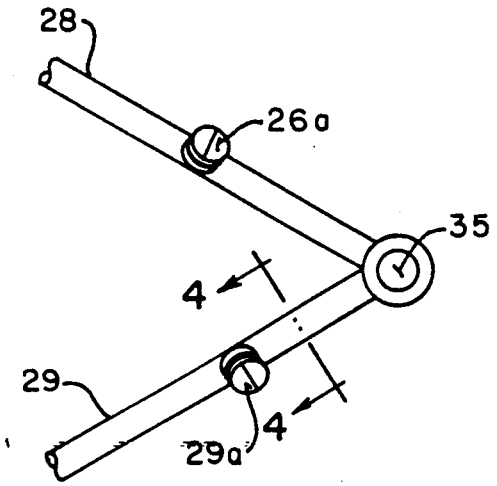
FIG. 3 is an inside view of a spray header, cut away to show the nozzles.
Figure 4:
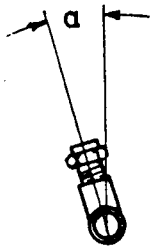
FIG. 4 is a section taken through A—A of FIG. 3

Examining these parameters specifically, the outwardly inclined nozzle angles are clearly shown in FIG. 3. It is apparent that each nozzle is inclined away from the opposite manifold. Thus nozzle 29*a* on lower manifold 29 is inclined away from manifold 28, relative to the plane in which manifold 29 lies. Nozzles 28*a*, on the other hand, is inclined, with respect to plane in which it lies, away from manifold 29, This angle of inclination is shown in FIG. 4. FIG. 4 is a cross section taken through A—A of mainfold 29 in FIG. 3, and it shows angle a—a, which in the preferred embodiment of the invention, is about 8 degrees.

FIG. 3 also shows that the nozzle on upper manifold 28 is farther from the pivot point or oscillation axis 35 than is the nozzle on the lower manifold. To inscribe a cardioid this offset of spray nozzles is necessary. Again considering the preferred embodiment, the upper nozzle 28*a* can be about two inches from the axis and the lower nozzle 29*a* can be about an inch from the axis, given a manifold radius of about eight inches. In addition it is evident from the line across the nozzle faces in FIG. 3, that nozzles 28*a* and 29*a* dispense fan sprays rather than cone sprays. In order to inscribe the cardioid, keeping spray from those nozzles from running into the ears, the fan sprays must also be perpendicular to the plane of the manifold.

Figure 5:
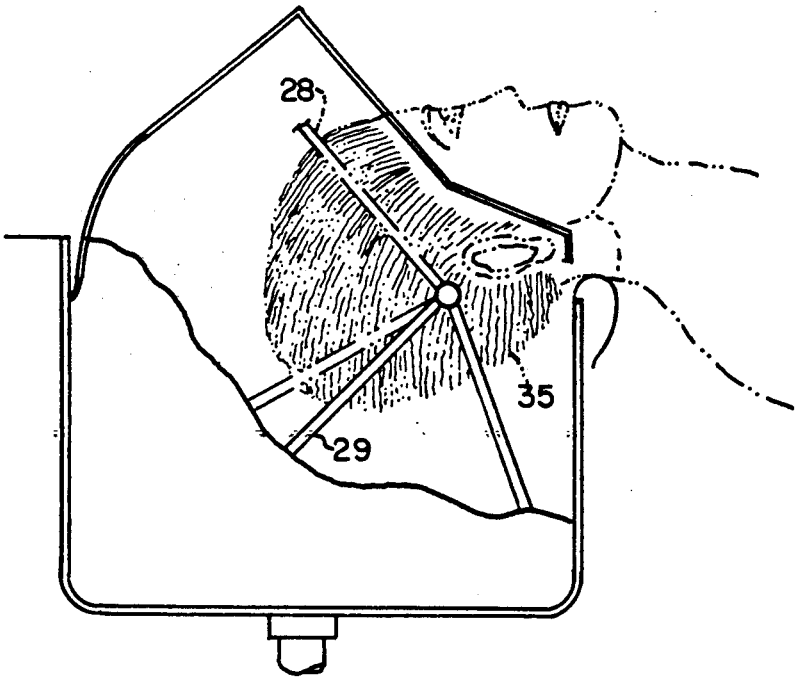
FIG. 5 is a cutaway view showing the position of the spray nozzle header oscillation axis relative to the ear.

Referring now to FIG. 5, it can be seen that the oscillation axis 35 of the header including manifolds 28 and 29 is located beyond and below the ear. Consider a Cartesian plane through the external ear, the helix, with the orgin of the intersecting x-axis and y-axis at the ear passage. Given that coordinate system, in the preferred embodiment this oscillation axis 35 should be on a line about 210 degrees from the origin, extending into the third quadrant. Preferably also, on this line the header oscillating axis should be about 3.3 inches from the origin. Given these criteria, sprays are found to complement each other forming the curve around the ears contacting the scalp behind the ears without solutions running into the ear passages.

In the light of the teachings of this invention modifications will occur to those skilled in this field. Thus, whereas on nozzle on each manifold opposite each ear is described, more than four nozzles can be included if desired. In addition some latitude is permitted both in the placement of the header axis, and in the angle of nozzle inclination. Whereas the preferred location of the axis of oscillation is on the 210 degree line from the origin, any line 200 to 220 degrees from the origin is desirable. Moreover it is to be understood that the inclined nozzles on the lower spray must be closer to the oscillatory axis, say one to three inches, than the inclined nozzles on the upper manifold, which can be 2 to 4 inches from the origin. Further, where the preferred angle of nozzle inclination is 8 degrees, an angle of 7 to 9 degrees can be employed. It is to be understood that all of these parameters depend upon the location of the header oscillation axis. However having been given the relationships herein, other changes will be obvious in the light of considerations outlined. Since such ramifications will occur to those working in this field, they are deemed to be within the scope of this invention.

What is claimed is:

1. In the apparatus for use in applying hair and scalp treating solutions to the human head, which includes a bowl, a closure therefor adapted to enclose the head with the face outside the closure and the back of the neck on the bowl front, an arcuate header including upper and lower spray manifolds adapted to oscillate in an arc from a point opposite the forehead to a point opposite the neck, means imparting partial rotation to the arcuate header to effect said oscillatory movement, a plurality of nozzles disposed on each manifold to dispense adjacent pressurized sprays of treating solutions, means enabling spray from the manifolds to contact an area behind one's ears wherein at least one nozzle is disposed on each manifold opposite an ear so that spray therefrom reaches the ear, wherein the said at least one nozzle on the lower manifold is so disposed that it is inclined away from the upper manifold at an angle of inclination with respect to the plane in which the lower arcuate manifold lies, wherein the said at least one nozzle on the upper manifold is so disposed that it is inclined away from the lower manifold at an angle of inclination with respect to the plane in which the upper arcuate manifold lies, wherein the nozzles on each manifold are adapted to dispense fan sprays in a plane perpendicular to the plane through that manifold, and wherein the axis of the circle which the oscillatory arc would inscribe is offset from the ear, being positioned below the ear toward the top of the head so that the curve inscribed around the ear by spray from the inclined nozzles is the involute of a circle such that spray from the inclined nozzles contacs the scalp behind the ears.

2. The apparatus of claim 1 wherein the angle of nozzle inclination is 7 to 9 degrees, wherein the header axis defining the oscillatory arc, in terms of a cartesian coordinate system with the orgin of the x- y- axis is at the ear passage, is on a line 200 to 220 degrees from the origin, and wherein the distance on that line from the origin is 2 to 4 inches.

3. The apparatus of claim 2 wherein each manifold carries one inclined nozzle for each ear, wherein the oscillatory axis is on a line 210 degrees from the origin, wherein the distance of the axis on that line is 3.3 inches from the origin, and wherein the angle of nozzle inclination is 7 to 9 degrees.

* * * * *